US009772076B2

(12) United States Patent
Li et al.

(10) Patent No.: US 9,772,076 B2
(45) Date of Patent: Sep. 26, 2017

(54) CUTTABLE FLEXIBLE LIGHT ENGINES

(71) Applicants: Ming Li, Acton, MA (US); Robert Harrison, North Andover, MA (US); Keng Chen, Sudbury, MA (US); Arnulf Rupp, Oberhaching (DE)

(72) Inventors: Ming Li, Acton, MA (US); Robert Harrison, North Andover, MA (US); Keng Chen, Sudbury, MA (US); Arnulf Rupp, Oberhaching (DE)

(73) Assignee: OSRAM SYLVANIA Inc., Wilmington, MA (US)

( * ) Notice: Subject to any disclaimer, the term of this patent is extended or adjusted under 35 U.S.C. 154(b) by 183 days.

(21) Appl. No.: 14/228,468

(22) Filed: Mar. 28, 2014

(65) Prior Publication Data

US 2015/0092413 A1 Apr. 2, 2015

Related U.S. Application Data

(60) Provisional application No. 61/884,941, filed on Sep. 30, 2013.

(51) Int. Cl.
*H05B 37/00* (2006.01)
*F21S 4/00* (2016.01)
(Continued)

(52) U.S. Cl.
CPC ..... *F21S 4/005* (2013.01); *F21S 4/20* (2016.01); *F21S 4/22* (2016.01); *F21S 4/24* (2016.01);
(Continued)

(58) Field of Classification Search
CPC .... H05B 33/08; H05B 37/02; H05B 33/0827; H05B 33/0803; F21S 4/005; F21S 4/007
(Continued)

(56) References Cited

U.S. PATENT DOCUMENTS 5,661,374 A * 8/1997 Cassidy ..... G05F 1/577 315/185 R
7,750,576 B2 * 7/2010 Pan ..... F21S 4/001 315/122
(Continued)

FOREIGN PATENT DOCUMENTS

CN 102 956 204 A 3/2013
DE 100 51 528 A1 5/2002
(Continued)

OTHER PUBLICATIONS

Eric Prevot, International Search Report and Written Opinion of the International Searching Authority for PCT/EP2013/050650, May 31, 2013, pp. 1-8, European Patent Office, Rijswijk, The Netherlands.
(Continued)

*Primary Examiner* — Tung X Le
(74) *Attorney, Agent, or Firm* — Shaun P. Montana

(57) ABSTRACT

Flexible light engines capable of being cut, and methods thereof, are provided. A cuttable flexible light engine includes a flexible strip and strings of solid state light sources coupled in parallel. A voltage balancer establishes a desired current flow through the strings of solid state light sources when the flexible strip is cut to a desired length, and may be part of a connector placed where the strip is cut. The strings may be provided in a first set of strings coupled in parallel between a first conductive path and an intermediate conductive path and a second set of strings coupled in parallel between the intermediated conductive path and a second conductive path. A cuttable flexible light engine may also include test points positioned within the strings.

20 Claims, 11 Drawing Sheets

(51) Int. Cl.

| | |
|---|---|
| ***H05B 33/08*** | (2006.01) |
| ***F21S 4/22*** | (2016.01) |
| ***F21S 4/20*** | (2016.01) |
| ***F21S 4/24*** | (2016.01) |
| *F21S 2/00* | (2016.01) |
| *F21Y 115/10* | (2016.01) |

(52) U.S. Cl.
CPC ..... *H05B 33/0803* (2013.01); *H05B 33/0827* (2013.01); *F21S 2/00* (2013.01); *F21Y 2115/10* (2016.08); *Y10T 29/49004* (2015.01); *Y10T 29/49169* (2015.01)

(58) Field of Classification Search
USPC ..... 315/185 R, 200 R, 291, 294; 362/249, 362/252, 555, 800
See application file for complete search history.

(56) References Cited

U.S. PATENT DOCUMENTS

| | | | | |
|---|---|---|---|---|
| 8,410,720 | B2 * | 4/2013 | Holec | F21V 23/005 315/209 R |
| 9,115,858 | B2 * | 8/2015 | Levante | F21S 4/005 |
| 9,539,932 | B2 * | 1/2017 | Fay | B60Q 1/0088 |
| 2004/0037079 | A1 | 2/2004 | Luk | |
| 2004/0252503 | A1 | 12/2004 | Lin | |
| 2005/0231947 | A1 * | 10/2005 | Sloan | F21S 4/003 362/235 |
| 2007/0115671 | A1 | 5/2007 | Roberts et al. | |
| 2007/0164683 | A1 * | 7/2007 | Allen | H05B 33/0803 315/200 R |
| 2007/0195025 | A1 | 8/2007 | Korcharz et al. | |
| 2008/0157686 | A1 * | 7/2008 | Chung | H05B 33/0809 315/185 S |
| 2009/0251068 | A1 | 10/2009 | Holec et al. | |
| 2010/0164409 | A1 * | 7/2010 | Lo | H05B 33/0803 315/312 |
| 2010/0181919 | A1 | 7/2010 | Sloan et al. | |
| 2011/0062872 | A1 | 3/2011 | Jin et al. | |
| 2011/0193105 | A1 | 8/2011 | Lerman et al. | |
| 2011/0266964 | A1 * | 11/2011 | Schlenk | H05B 33/0821 315/192 |
| 2012/0002417 | A1 * | 1/2012 | Li | F21V 17/007 362/249.02 |
| 2012/0044689 | A1 | 2/2012 | Kraus et al. | |
| 2013/0069536 | A1 | 3/2013 | Ni | |
| 2013/0107514 | A1 * | 5/2013 | McNabb | F21V 21/00 362/231 |
| 2013/0147359 | A1 | 6/2013 | Chobot | |
| 2014/0062314 | A1 * | 3/2014 | Moskowitz | H05B 33/0827 315/185 R |

FOREIGN PATENT DOCUMENTS

| | | | |
|---|---|---|---|
| DE | 10 2009 008095 | A1 | 8/2010 |
| DE | 10 2012 107766 | A1 | 2/2013 |
| NO | 2013/011422 | A1 | 1/2013 |
| WO | 2007013003 | A1 | 2/2007 |
| WO | 2012/145766 | A2 | 10/2012 |

OTHER PUBLICATIONS

Joao Carlos Silva, International Search Report and Written Opinion of the International Searching Authority for PCT/US14/57125, May 6, 2015, pp. 1-16, European Patent Office, Rijswijk, The Netherlands.

* cited by examiner

CUTTABLE FLEXIBLE LIGHT ENGINES

CROSS-REFERENCE TO RELATED APPLICATION

The present application claims priority of U.S. Provisional Patent Application No. 61/884,941, filed on Sep. 30, 2013, the entire contents of which are hereby incorporated by reference.

TECHNICAL FIELD

The present invention relates to lighting, and more particularly, to cuttable flexible light engines.

BACKGROUND

A conventional light engine and/or module includes one or more solid state light sources that are driven by a constant voltage source. Each light engine, for example, may include one or more solid state light sources connected in an electrical circuit by conductive traces on a circuit substrate. The circuit substrate is typically made of relatively stiff material, such as fiber reinforced epoxy (e.g., FR4) or polyimide.

SUMMARY

Although such conventional light engines are useful, the use of relatively stiff circuit substrates may impose design limitations. Technology has therefore been developed to produce flexible light engines incorporating flexible substrate materials such as plastics. Flexible light engines allow freedom in design and installation. For example, a flexible light engine may be installed on a curved or irregular surface by bending the flexible light engine around the surface. Also, flexible light engines may be stored in a roll and constructed using roll-to-roll manufacturing techniques. In roll-to-roll manufacturing techniques, the flexible light engines are manufactured by coupling the solid state light sources to conductive traces on a continuous web of flexible substrate material. Roll-to-roll manufacturing may facilitate efficient mass production of high performance flexible light engines. Roll-to-roll manufacturing, relatively inexpensive substrate materials, and the ability to package long rolls of flexible light engines in a single package also contribute to a relatively low cost of flexible light engines compared to rigid light engines.

One issue with flexible light engines, however, is that they are frequently limited to being cut to desired lengths only at particular pre-defined areas. For example, a flexible light engine including solid state light sources may be cuttable at one foot intervals, allowing a luminaire manufacturer to use the same light engine type in a product needing just a single foot of light engine and in a different product requiring three feet of light engine. The luminaire designer, instead of purchasing pre-cut one foot and three foot light engine products, is able to purchase a single flexible light engine product and cut it according to needs. This flexibility is a tremendous advantage and may provide significant cost savings.

However, there are of course still limitations present. The flexible light engine is cuttable only at certain pre-defined intervals. Those intervals may not allow a user to reach an amount of light engine that is desired. For example, again referring to a flexible light engine product that may be cut at one foot intervals, such a product is quite useful if the user is going to need one foot light engines, two foot light engines, three foot light engines, and so on, but is less useful if the user will need a light engine that is a one and a half feet in length. If the user attempts to cut the flexible light engine at any place other than the pre-designated cut location, the light engine will not function. The light engine is designed to deal with a particular forward voltage drop over a certain number of solid state light sources, and is manufactured so that it is able to be cut at only the pre-designated locations. Cutting the light engine at a different location will cause a change in the forward voltage drop, which the light engine is not capable of handling, and because it was not accounted for in the design, will likely cause other problems even if the change in forward voltage drop was not large. For example, and depending on the layout of the circuit on the flexible substrate, a cut at a non-designated location may sever the connection between one or more solid state light sources that are part of the desired light engine and the remaining solid state light sources of the desired light engine. Thus, it would be useful to be able to cut a flexible light engine at any desired length, instead of only at predetermined cut locations.

Embodiments of the present invention provide a cuttable flexible light engine, that is capable of being cut where desired. In general, embodiments include a plurality of parallel-connected strings of solid state light sources. The cuttable flexible light engines may be cut between the parallel-connected strings of solid state light sources or within a string of the parallel-connected strings of solid state light sources to provide the flexible light engine in a desired length. The cuttable flexible light engines may include voltage balancing to at least partially replace the voltage drop associated with solid state light sources cut from the light engine. Alternatively, or additionally, the flexible light engines may be configured in groups of parallel-connected strings where cutting the light engine at one of the strings or within one of the strings results in acceptable current change in the remaining strings. The flexible light engines may also, or alternatively, be configured to include test points to facilitate testing of the cuttable flexible light engines.

In an embodiment, there is provided a flexible light engine. The flexible light engine includes: a flexible strip; a first string of solid state light sources, comprising a first plurality of solid state light sources, and a second string of solid state light sources, comprising a second plurality of solid state light sources, coupled to the flexible strip; and a voltage balancer coupled to at least the first string of solid state light sources, wherein the voltage balancer is configured to establish a desired current flow through the first string of solid state light sources and the second string of solid state light sources.

In a related embodiment, the voltage balancer may be coupled in series with the first string of solid state light sources between a first conductive path and a second conductive path, and the series connection between the first string of solid state light sources and the voltage balancer may be coupled in parallel with the second string of solid state light sources. In another related embodiment, the voltage balancer may be provided in a connector coupled to the flexible strip. In still another related embodiment, the flexible light engine may further include a connector having a first connection point coupled to a first conductive path and a second connection point coupled to a second conductive path, wherein the voltage balancer may be coupled between an intermediate connection point of the connector and the first string of solid state light sources adjacent a designated cut location, and wherein the first string of solid state light sources and the second string of solid state light sources may be coupled in parallel between the first conductive path and the second conductive path prior to a cut at the designated cut location, and wherein the voltage balancer may be configured to be coupled in series with a portion of the first string of solid state light sources between the first conductive path and the second conductive path by connecting the first connection point to the additional connection point after the flexible strip is cut at the designated cut location.

In yet another related embodiment, the voltage balancer may be coupled to the first string of solid state light sources adjacent a designated cut location, and the flexible light engine may further include a switch circuit coupled to the voltage balancer, the switch circuit may have a first state and a second state, the first state may be configured to couple the first string of solid state light sources and the second string of solid state light sources in parallel between a first conductive path and a second conductive path, the second state may be configured to couple the voltage balancer in series with a portion of the first string of solid state light sources between the first conductive path and the second conductive path, whereby the switch circuit may be configured to automatically enter the second state when the flexible strip is cut at the designated cut location. In a further related embodiment, the voltage balancer and the switch circuit may be provided in a connector coupled to the flexible strip. In another further related embodiment, the switch circuit may include a transistor.

In still yet another related embodiment, the flexible light engine may further include a plurality of test points along a length of the flexible strip, a first test point in the plurality of test points may be positioned within the first string of solid state light sources and a second test point in the plurality of test points may be positioned within the second string of solid state light sources.

In another embodiment, there is provided a flexible light engine. The flexible light engine includes: a flexible strip; and a plurality of strings of solid state light sources coupled to the flexible strip, a first set of strings of solid state light sources in the plurality of strings of solid state light sources being coupled in parallel between a first conductive path and an intermediate conductive path, and a second set of strings of solid state light sources in the plurality of strings of solid state light sources being coupled in parallel between the intermediate conductive path and a second conductive path.

In a related embodiment, the flexible light engine may further include a plurality of connectors coupled to the flexible strip, whereby pairs of strings of solid state light sources in the plurality of strings of solid state light sources may be coupled to the flexible strip between associated successive ones of the plurality of connectors, each pair of strings of solid state light sources in the plurality of strings of solid state light sources may include one of the strings of solid state light sources from the first set of strings of solid state light sources in the plurality of strings of solid state light sources and one of the strings of solid state light sources from the second set of strings of solid state light sources in the plurality of strings of solid state light sources.

In another related embodiment, the number of the plurality of strings of solid state light sources in each of the first set of strings of solid state light sources and the second set of strings of solid state light sources may be greater than five.

In another embodiment, there is provided a method of making a flexible light engine. The method includes: providing a flexible strip having a plurality solid state light sources coupled thereto, the plurality of solid state light sources being configured in strings of the solid state light sources coupled in parallel; cutting the flexible strip to establish a length of the flexible light engine, whereby the flexible light engine comprises a portion of the flexible strip and a plurality of remaining ones of the solid state light sources coupled to the portion of the flexible strip; and coupling a voltage balancer to the plurality of remaining ones of the solid state light sources.

In a related embodiment, the plurality of remaining ones of the solid state light sources may include a portion of one of the strings of the solid state light sources, and coupling a voltage balancer to the plurality of remaining ones of the solid state light sources may include coupling the voltage balancer in series with the portion of one of the strings of the solid state light sources. In a further related embodiment, coupling the voltage balancer in series with the portion of one of the strings of the solid state light sources may include automatically changing the state of a switch by the cutting the flexible strip to establish the length of the flexible light engine.

In another embodiment, there is provided a method of making a flexible light engine. The method includes: providing a flexible strip; and coupling a plurality of strings of solid state light sources to the flexible strip, wherein the plurality of strings of solid state light sources comprises a first set of strings and a second set of strings, wherein the first set of strings is coupled in parallel between a first conductive path and an intermediate conductive path, and wherein the second set of strings is coupled in parallel between the intermediate conductive path and a second conductive path.

In a related embodiment, the method may further include coupling a plurality of connectors to the flexible strip, whereby pairs of the plurality of strings of solid state light sources are coupled to the flexible strip between associated successive ones of the connectors in the plurality of connectors, each pair of the plurality of strings of solid state light sources comprising one of the strings of solid state light sources from the first set of strings and one of the strings of solid state light sources from the second set of strings. In another related embodiment, the method may further include cutting the flexible strip to remove at least one of the strings of solid state light sources from the first set of strings and at least one of the strings of solid state light sources from the second set of strings. In still another related embodiment, the method may further include cutting the flexible strip to remove at least one of the strings of solid state light sources from the first set of strings without removing any of the strings of solid state light sources from the second set of strings.

In another embodiment, there is provided a method of making a flexible light engine. The method includes: providing a flexible strip; coupling a plurality of strings of solid state light sources to the flexible strip in parallel between a first conductive path and a second conductive path; and providing a plurality of test points, each of the test points in the plurality of test points being positioned within an associated one of the strings of solid state light sources in the plurality of strings of solid state light sources.

In a related embodiment, the method may further include testing each of the plurality of strings of solid state light sources by applying a voltage between the first conductive path and the test point associated with the string of solid state light sources in the plurality of strings of solid state light sources and applying a voltage between the test point associated with the string of solid state light sources in the plurality of strings of solid state light sources and the second conductive path.

In another embodiment, there is provided a method of making a flexible light engine. The method includes: providing a flexible strip; coupling a plurality of solid state light sources to the flexible strip; cutting the flexible strip between two or more of the solid state light sources to establish a desired length of the flexible light engine; and coupling a constant current power supply to the flexible strip.

In a related embodiment, the method may further include selecting each solid state light source in the plurality of solid state light sources by binning, such that each solid state light source in the plurality of solid state light sources has substantially the same forward voltage drop.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
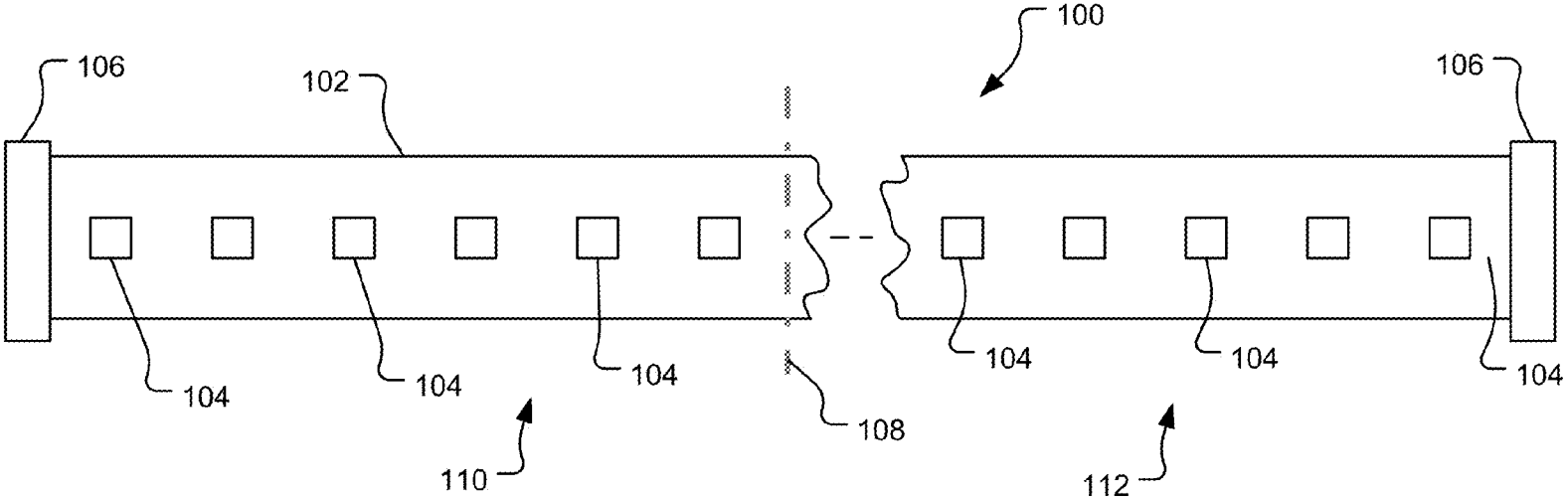
FIG. 1 shows a top view of a cuttable flexible light engine according to embodiments disclosed herein.

FIG. 1 shows a top view of a flexible light engine 100. The flexible light engine 100 includes a flexible strip 102, a plurality of solid state light sources 104, and electrical connectors 106 at each end of the flexible strip 102. The term "flexible" when used throughout in reference to a flexible light engine 100 or a flexible strip 102 refers to a flexible light engine 100 or flexible strip 102 that may be readily bent or flexed compared to a light engine or strip constructed using, for example but not limited to, a rigid substrate such as fiber reinforced epoxy (e.g., FR4) or polyimide. The term "solid state light source" throughout refers to one or more light emitting diodes (LEDs), organic light emitting diodes (OLEDs), polymer light emitting diodes (PLEDs), organic light emitting compounds (OLECs), and other semiconductor-based light sources, including combinations thereof, whether connected in series, parallel, or combinations thereof. In general, the solid state light sources 104 in the flexible light engine 100 are electrically connected in a plurality of strings, with each string including some of the solid state light sources 104, that are connected in parallel. The flexible light engine 100 may be, and in some embodiments is, cut between two of the strings of solid state light sources 104 or within one of the strings of solid state light sources 104. References herein to flexible light engines or flexible strips that may be "cut" or are "cuttable" refers to flexible light engines or flexible strips that may be readily cut using a hand tool (not shown in the figures) such as scissors, a utility knife, metal shears, etc. For example, the flexible light engine 100 of FIG. 1 may be, and in some embodiments is, cut along a line 108 to separate the flexible light engine 100 into a first flexible light engine 110 and a second flexible light engine 112, each of a desired length. The first flexible light engine 110 and the second flexible light engine 112 may each, and in some embodiments do, include an associated plurality of the strings of solid state light sources 104 provided in the flexible light engine 100 and/or associated portions of the strings of solid state light sources 104 provided in the flexible light engine 100. In some embodiments, for example, the flexible light engine 100 has a width of substantially 40 mm and a length of substantially 20 meters or more, and is cut into one or more separate flexible light engines, e.g. the first flexible light engine 110 and the second flexible light engine 112, of desired lengths, to accommodate a particular application or use.

Figure 2:
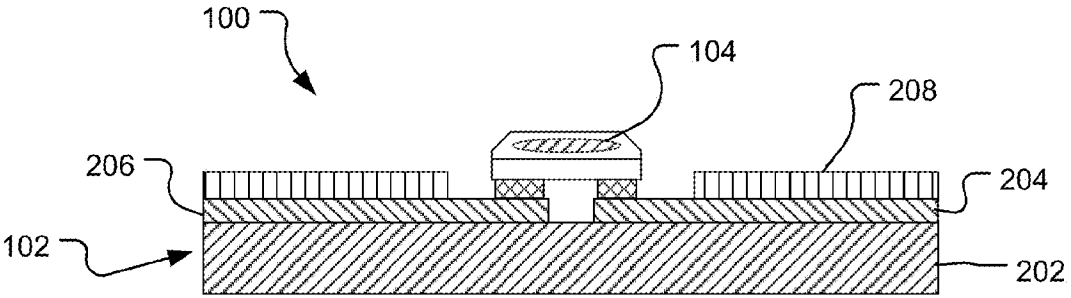
FIG. 2 diagrammatically illustrates a sectional view of the cuttable flexible light engine shown in FIG. 1 according to embodiments disclosed herein.

FIG. 2 diagrammatically illustrates a sectional view of the flexible light engine 100 illustrated in FIG. 1. As shown, the flexible strip 102 includes a flexible substrate 202, conductive traces 204, 206 and a mask 208. Each of the solid state light sources 104 in the flexible light engine 100 of FIG., one of which is shown in the sectional view of FIG. 2, is electrically coupled to conductive traces 204, 206, to couple strings of the solid state light sources 104 in parallel. The flexible substrate 202 may be, and in some embodiments is, formed from any material or combination of materials suitable for use as a flexible substrate for a light engine. In some embodiments, the flexible substrate 202 is in the form of an electrically insulating flexible sheet, a woven and/or non-woven material, a flexible composite, combinations thereof, and the like. The flexible substrate 202 may be, for example, and in some embodiments is, formed from any suitably flexible material, such as a polymer, a polymer composite, a polymer fiber composite, a metal, a laminate, and/or combinations thereof. Non-limiting examples of suitable polymer materials that may be used to form such sheets include shapeable polymers such as polyetheylene (PE), polypropylene (PP), polyethylene terephthalate (PET), polyimide (PI), polyamides, polyethylene napthalate (PEN), polyether ether ketone (PEEK), combinations thereof, and the like.

The conductive traces 204, 206 may be, and in some embodiments are, formed of any conductive material with conductivity that is sufficient for electrical applications. In some embodiments, for example, the conductive traces 204, 206 are formed of a metal such as but not limited to copper, silver, gold, aluminum, or the like, that is printed, deposited, and/or plated on a surface of the flexible substrate 202 so as to correspond to a pattern for establishing parallel connections of a plurality of strings of solid state light sources 104 on the flexible substrate 202. In some embodiments, for example, the conductive traces 204, 206 are formed on the flexible substrate 202 using a known develop-etch-strip (DES) process.

The solid state light sources 104 are electrically coupled to the conductive traces 204, 206 using any suitable means for establishing and/or maintaining an electrical connection between the solid state light sources 104 and the conductive traces 204, 206. In some embodiments, for example, the solid state light sources 104 are electrically coupled to the conductive traces 204, 206 using solder, and in some embodiments, the electrical coupling is achieved through use of and/or via an adhesive, wire bonding, die bonding, and the like (all not shown).

The mask 208 is provided over the conductive traces 204, 206 to protect the conductive traces 204, 206 against shorting and/or against environmental elements such as rain, snow, dust, etc. The mask 208 is formed from an electrically insulating flexible material, and in some embodiments is formed of the same material as the flexible substrate 202. The mask 208, for example, may be, and in some embodiments is, formed from any suitably flexible material, such as but not limited to a polymer, a polymer composite, a polymer fiber composite, a metal, a laminate, and/or combinations thereof. Non-limiting examples of suitable polymer materials that may be used to form such sheets include shapeable polymers such as polyetheylene (PE), polypropylene (PP), polyethylene terephthalate (PET), polyimide (PI), polyamides, polyethylene napthalate (PEN), polyether ether ketone (PEEK), combinations thereof, and the like.

For ease of explanation, the flexible light engine 100 illustrated in FIG. 1 is formed using an elongate flexible strip 102. It is to be understood, however, that a flexible light engine 100 consistent with the present disclosure may be provided in a variety of configurations, e.g. in a rectangular or square sheet. Embodiments illustrated and described herein in connection with an elongate flexible strip 102 are thus provided by way of illustration not of limitation.

Figure 3:
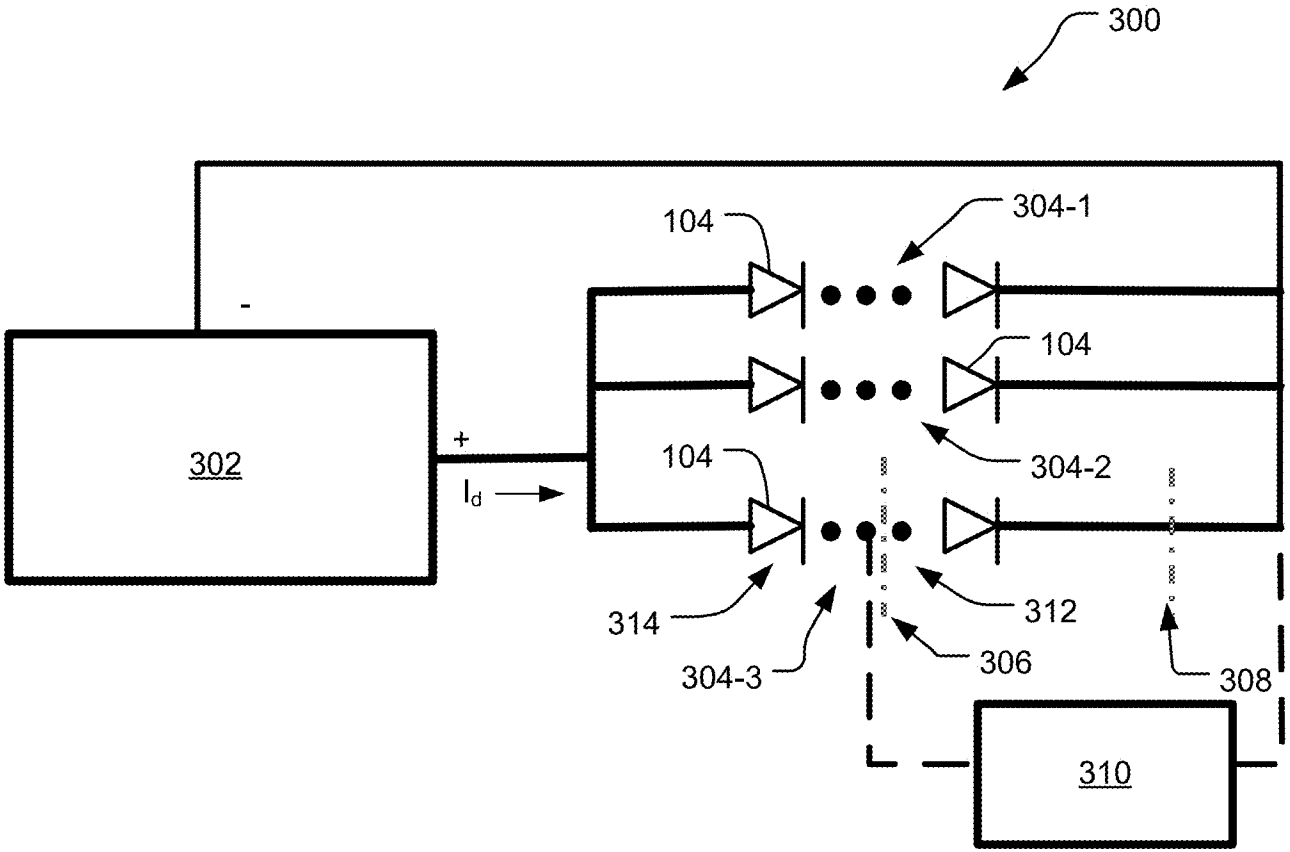
FIG. 3 is circuit diagram illustrating a circuit formed in a cuttable flexible light engine according to embodiments disclosed herein.

FIG. 3 is a circuit diagram of an electrical circuit 300 formed in a flexible light engine 100. The electrical circuit 300 includes a constant current power supply 302 and a plurality of strings 304-1, 304-2, 304-3 of solid state light sources 104 connected in parallel between positive (+) and negative (−) terminals of the constant current power supply 302. Each of the strings 304-1, 304-2, 304-3 includes a plurality of series-connected solid state light sources 104. In FIG. 3 and other embodiments described herein, a particular number of strings of solid state light sources 104 may be shown for simplicity. It is to be understood, however, that any number of strings of solid state light sources 104 may be provided in a flexible light engine 100 without departing from the scope of the invention. The constant current power supply 302 is any known electrical power supply capable of driving the plurality of strings 304-1, 304-2, 304-3 with a constant drive current $I_d$. Driving the plurality of strings 304-1, 304-2, 304-3 with a constant current, as opposed to a constant voltage, allows for efficient operation of the solid state light sources 104 within the plurality of strings 304-1, 304-2, 304-3. The plurality of strings 304-1, 304-2, 304-3 may be, and in some embodiments are, configured to have substantially the same resistance so that the current through each of the strings in the plurality of strings 304-1, 304-2, 304-3 is substantially the same, thereby providing consistent light output for the solid state light sources 104 in each of the plurality of strings 304-1, 304-2, 304-3. For example, in some embodiments, each of the strings in the plurality of strings 304-1, 304-2, 304-3 includes the same number and type of series-connected solid state light sources 104.

The number of solid state light sources 104 in each string the plurality of strings 304-1, 304-2, 304-3 is selected depending on a variety of factors including, for example but not limited to, the voltage rating of the constant current power supply 302. Readily available known constant current power supplies may, for example, have a voltage rating of 50V. To efficiently operate a 50V constant current power supply, each of the strings in the plurality of strings 304-1, 304-2, 304-3 of solid state light sources 104 coupled in parallel across the power supply may be configured to have a voltage drop of at least about 30V. For example, in embodiments where each solid state light source 104 used in the plurality of strings 304-1, 304-2, 304-3 of solid state light sources 104 has a forward voltage drop of about 3V, at least ten solid state light sources 104 should be provided in each string in the plurality of strings 304-1, 304-2, 304-3 to achieve a forward voltage drop of about 30V for each string in the plurality of strings 304-1, 304-2, 304-3. The forward voltage drop for each solid state light source 104 in a string in the plurality of strings 304-1, 304-2, 304-3 may vary from solid state light source 104 to solid state light source 104. Although binning may be, and in some embodiments is, used to group solid state light sources 104 into solid state light sources 104 having a common forward voltage drop, providing more solid state light sources 104 in each string in the plurality of strings 304-1, 304-2, 304-3 allows for averaging of the forward voltage drops of binned solid state light sources 104 and leads to a more consistent forward voltage drop associated with the entire plurality of strings 304-1, 304-2, 304-3. Accordingly, although embodiments may and do include any number of solid state light sources 104, the efficiency of the constant current power supply 302 is improved when using a larger number, e.g. ten or more, of solid state light sources 104 in each string in the plurality of strings 304-1, 304-2, 304-3.

In regards to the flexible light engine 100 shown in FIG. 1, the flexible light engine 100 may be, and in some embodiments is, cut to a desired length, e.g. by cutting one or more of the strings in the plurality of strings 304-1, 304-2, 304-3 and/or portions thereof from the light engine 100. As shown in FIG. 3, for example, the electrical circuit 300 may be cut within the string 304-3, e.g. between dashed lines 306 and 308, to remove a portion 312 of the string 304-3. If the portion 312 of the string 304-3 is cut from the plurality of strings 304-1, 304-2, 304-3 without any other change to the circuit 300, the current through the remaining strings 304-1 and 304-2 would increase. A voltage balancer 310 may be, and in some embodiments is, added to replace the portion 312 of the string 304-3 that is cut out. The voltage balancer 310 is configured so that any increase in current through the remaining strings 304-1 and 304-2 does not cause an undesirable increase in the light output of the solid state light sources 104 in the remaining strings 304-1 and 304-2 and/or damage the solid state light sources 104 in the remaining strings 304-1 and 304-2. The voltage balancer 310 is any component or device, or combination of components and/or devices, having substantially the same resistance as the portion 312 of the string 304-3 that was cut from the plurality of strings 304-1, 304-2, 304-3. The voltage balancer 310 may be, for example, and in some embodiments is, a resistor, a variable resistor, a diode, or any other device and/or combinations of devices, having substantially the same resistance as the portion 312 of the string 304-3 that was cut from the plurality of strings 304-1, 304-2, 304-3.

When the electrical circuit 300 is cut within the string 304-3, the voltage balancer 310 is connected in series with the remaining solid state light sources 314 in the string 304-3 so that the current through the remaining solid state light sources 314 is substantially the same as the current prior to when the portion 312 was cut from the string 304-3. The remaining solid state light sources 314 and the solid state light sources 104 in the remaining non-cut strings 304-1 and 304-2 thus provide substantially the same light output after the portion 312 is cut from the string 304-3, as they did prior to when the portion 312 was cut from the string 304-3, and are not subject to damage by, for example, an over-current condition.

Figure 4:
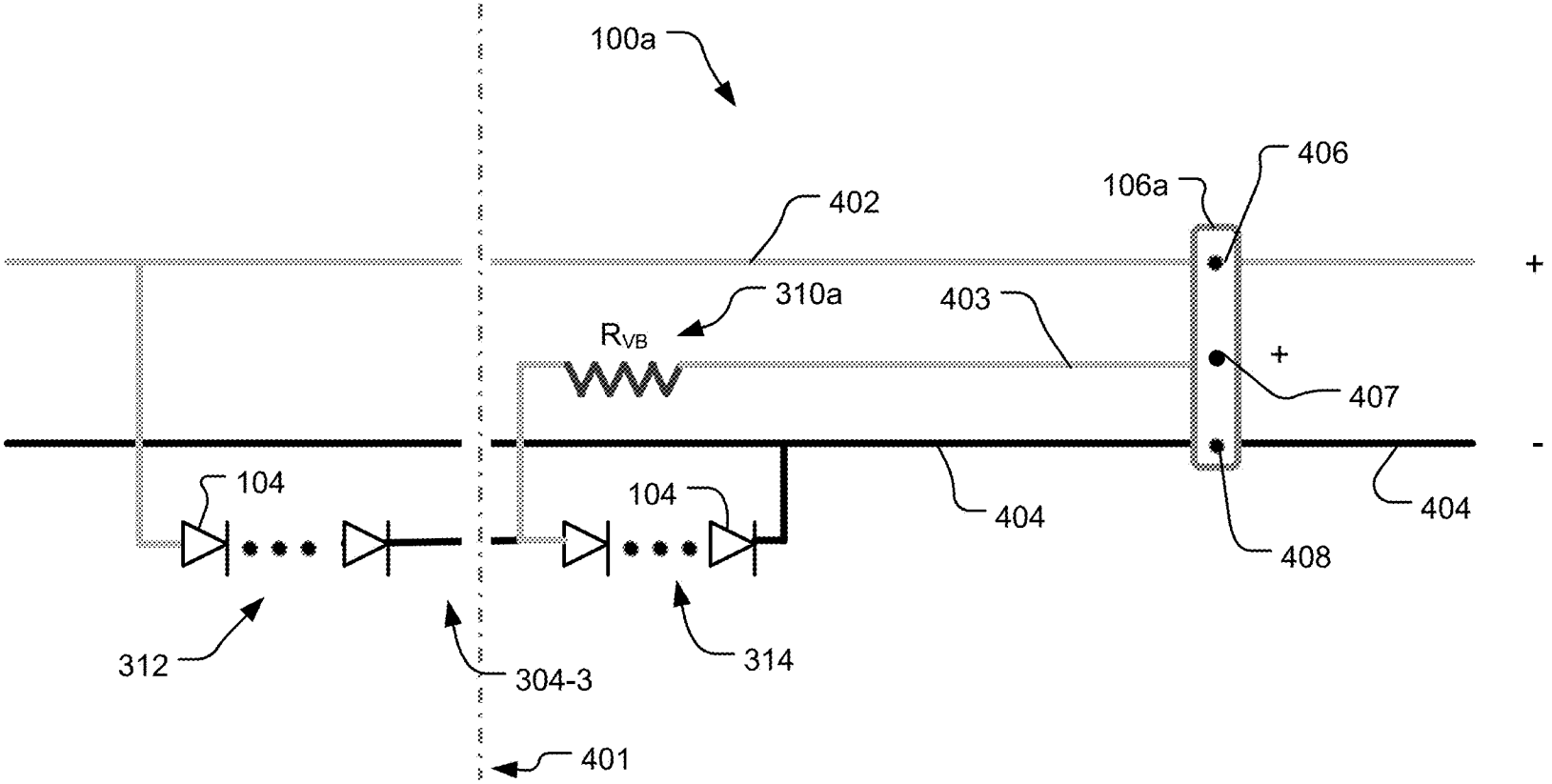
FIG. 4 diagrammatically illustrates a cuttable flexible light engine according to embodiments disclosed herein.

FIG. 4 diagrammatically illustrates an embodiment 100*a* of the flexible light engine 100 of FIG. 1 wherein the flexible light engine 100*a* is cut within a string 304-3 of solid state light sources 104, as described in connection with FIG. 3. In FIG. 4, the flexible light engine 100*a* was cut along a line 401, to remove the portion 312 of the string 304-3 from the circuit. The line 401, in some embodiments, is a designated cut location that is indicated on the strip portion 102 (shown in FIG. 1) of the flexible light engine 100*a*. Prior to the cut along the line 401, the string 304-3 was coupled between a first conductive path 402 and a second conductive path 404, e.g. in parallel with other strings 304-1, 304-2, of solid state light sources 104 that are not shown in FIG. 4 for ease of illustration, but are shown, for example, in FIG. 3. The first conductive path 402, in some embodiments, is coupled to a positive terminal (+) of a constant current power supply (such as the constant current power supply 302 shown in FIG. 3) and the second conductive path 404, in some embodiments, is coupled to the negative terminal (−) of the constant current power supply (such as the constant current power supply 302 shown in FIG. 3). A connector 106*a* provides facile electrical connection to the first conductive path 402 and the second conductive path 404. The connector 106*a*, in some embodiments, includes a first connection point 406 coupled to the first conductive path 402 and a second connection point 408 coupled to the second conductive path 404.

As shown, a voltage balancer 310*a* configured as a single voltage balance resistor $R_{VB}$ is coupled to remaining solid state light sources 314 in the string 304-3 to substantially replace the resistance of the solid state light sources 104 in the portion 312 of the string 304-3 when the portion 312 is cut from the string 304-3. The voltage balance resistor $R_{VB}$ may be, and in some embodiments is, coupled to an additional conductive path 403 formed in the flexible light engine 100*a*. One end of the voltage balance resistor $R_{VB}$ may be, and in some embodiments is, coupled to an additional connection point 407 on the connector 106*a*, and the other end of the voltage balance resistor $R_{VB}$ may be, and in some embodiments is, coupled between the portion 312 and the remaining solid state light sources 314 adjacent a designated cut location indicated by line 401, i.e. prior to the cut along the line 401.

When the flexible light engine is cut along the line 401, the voltage balance resistor $R_{VB}$ is, in some embodiments, coupled in series with the remaining solid state light sources 314 between the first conductive path 402 and the second conductive path 404, e.g. in parallel with other strings (not shown in FIG. 4) of solid state light sources in the flexible light engine 100*a*, by connecting the additional connection point 407 on the connector 106*a* to the first connection point 406 on the connector 106*a*. Alternatively, the voltage balance resistor $R_{VB}$, in some embodiments, is provided as a separate element installed by a user after the flexible light engine 100*a* is cut.

Figure 5:
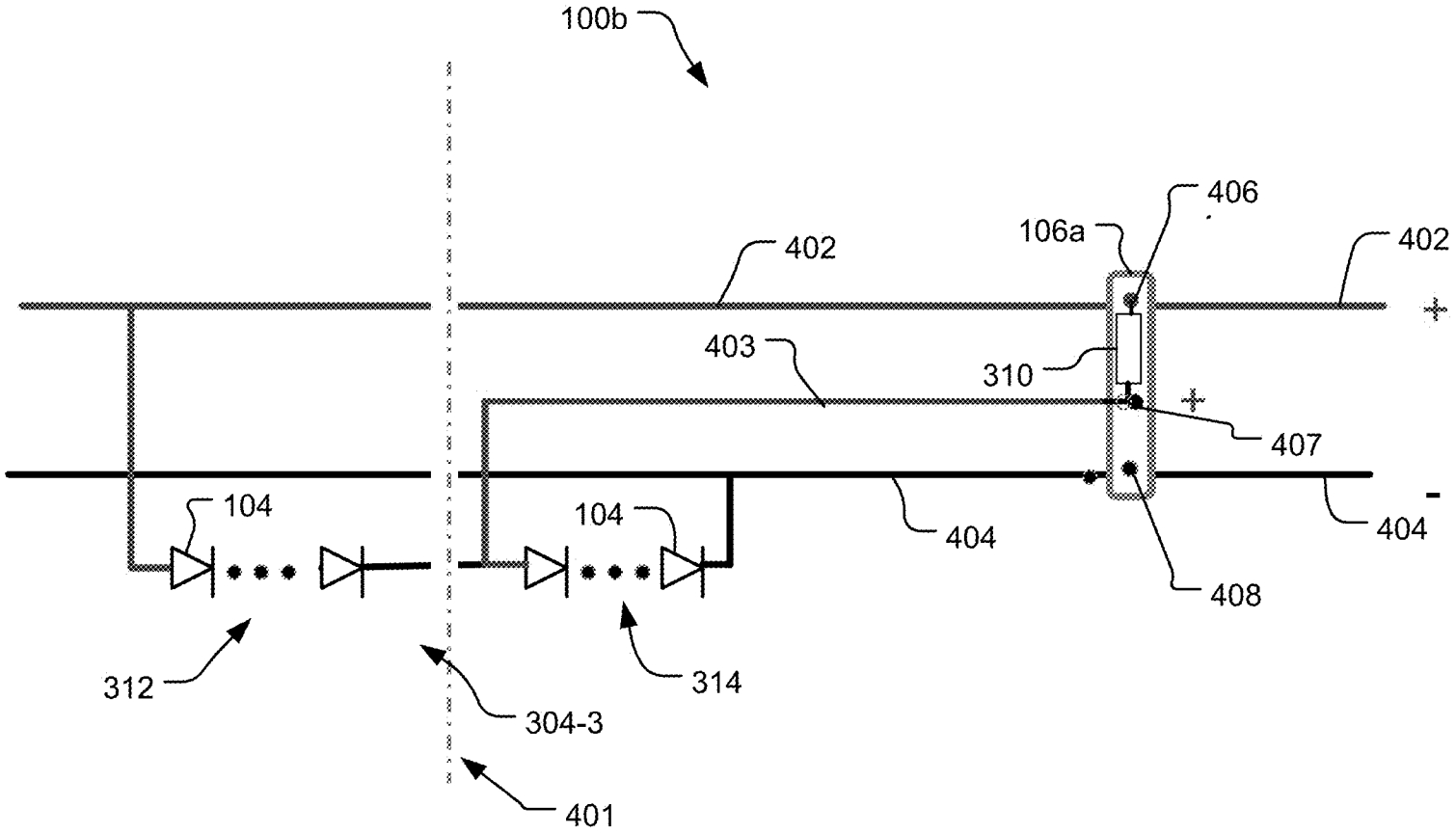
FIG. 5 diagrammatically illustrates another cuttable flexible light engine according to embodiments disclosed herein.

FIG. 5 illustrates an embodiment 100*b* of the flexible light engine 100 of FIG. 1 that is similar to the embodiment 100*a* illustrated in FIG. 4, except in FIG. 5, a voltage balancer 310*b* is provided in a connector 106*b*. In the flexible light engine 100*b*, one end of the additional conductive path 403 is coupled to the additional connection point 407 on the connector 106*b*, and the other end of additional conductive path 403 is coupled between the portion 312 that is cut from the string 304-3 and the remaining solid state light sources 314 from the strings 304-3 adjacent a designated cut location indicated by the line 401, i.e. prior to the cut along the line 401. When the flexible light engine 100*b* is cut along the line 401, the voltage balancer 310*b* is coupled in series with the remaining solid state light sources 314 between the first conductive path 402 and the second conductive path 404, e.g. in parallel with the other strings 304-1, 304-2 (not shown in FIG. 5 but shown in FIG. 3) of the solid state light sources 104 in the flexible light engine 100*b*, by connecting the voltage balancer 310*b* between the first connection point 406 and the additional connection point 407 in the connector 106*b*.

Figure 6:
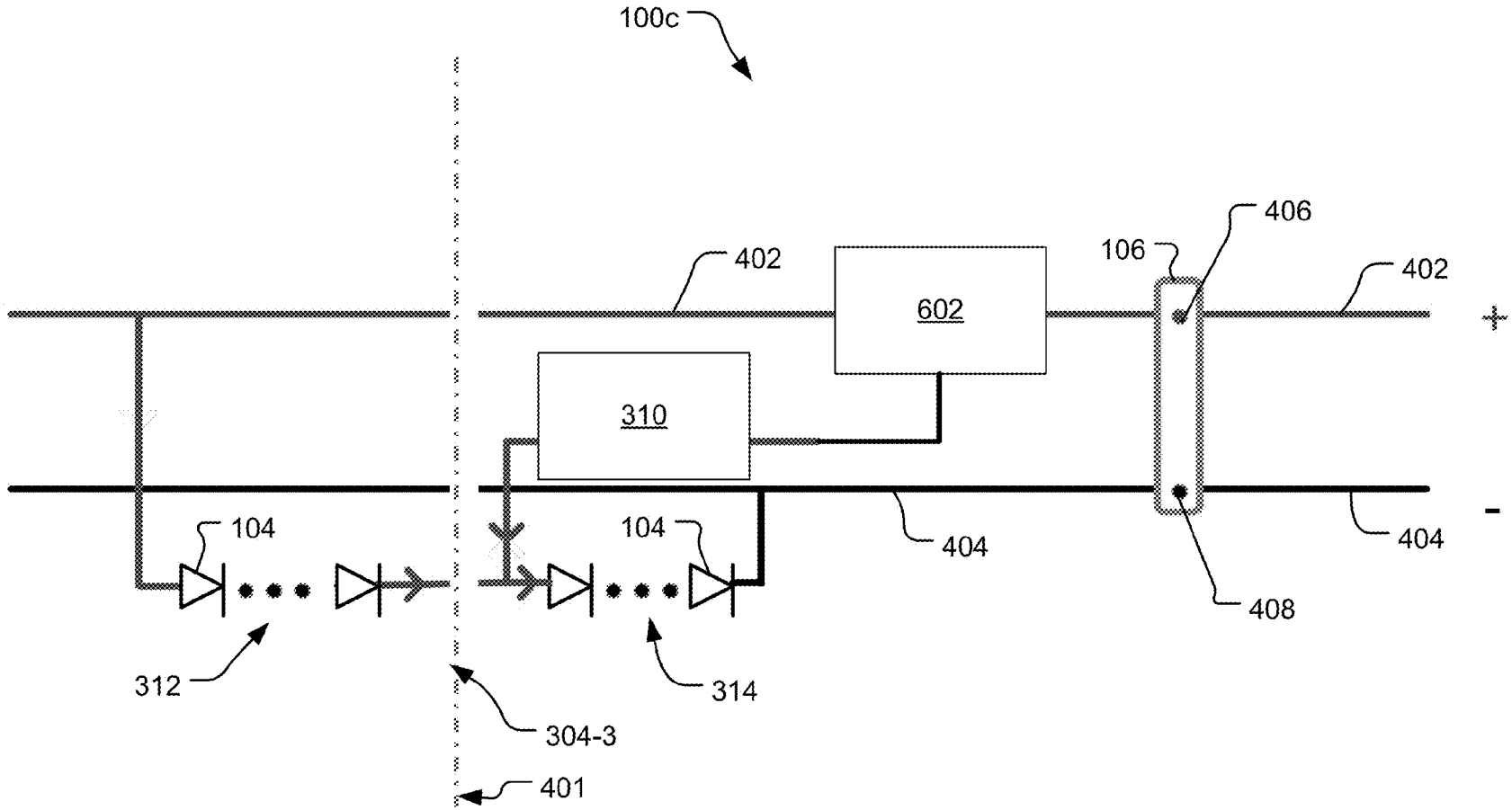
FIG. 6 diagrammatically illustrates a cuttable flexible light engine including a switch circuit according to embodiments disclosed herein.

FIG. 6 illustrates an embodiment 100*c* of the flexible light engine 100 shown in FIG. 1 and configured for automatically coupling a voltage balancer 310*c* in series with the remaining solid state light sources 314 in the string 304-3 of solid state light sources 104 when the flexible light engine 100*c* is cut within the string 304-3 of solid state light sources 104. The flexible light engine 100*c* includes a switch circuit 602 coupled to the first conductive path 402. One end of the voltage balancer 310*c* is coupled to the switch circuit 602 and the other end of the voltage balancer 310*c* is coupled between the portion 312 to be cut from the string 304-3 of the flexible light engine 100*c* and the remaining solid state light sources 314 adjacent a designated cut location indicated by the line 401, i.e. prior to the cut along the line 401. Prior to a cut at the designated cut location indicated by the line 401, the switch circuit 602 is in a first state to couple the first conductive path 402 to the portion 312 of the string 304-3 of the solid state light sources 104 so that the entire string 304-3 is coupled between the first conductive path 402 and the second conductive path 404, e.g. in parallel with other strings of solid state light sources (such as the strings 304-1 and 304-2 shown in FIG. 3) that are not shown in FIG. 6 for ease of illustration. When the switch circuit 602 is in the first state, the voltage balancer 310*c* is not coupled between the first conductive path 402 and the second conductive path 404. When the flexible light engine 100*c* is cut at the designated cut location indicated by the line 401, the switch circuit 602 automatically enters a second state. When the switch circuit 602 is in the second state, the voltage balancer 310*c* and the remaining solid state light sources 314 are placed in series between the first conductive path 402 and the second conductive path 404. No additional user operation is required to connect the voltage balancer 310 in series with the remaining solid state light sources 314 when the flexible light engine 100*c* is cut at the designated cut location indicated by the line 401.

Figure 7:
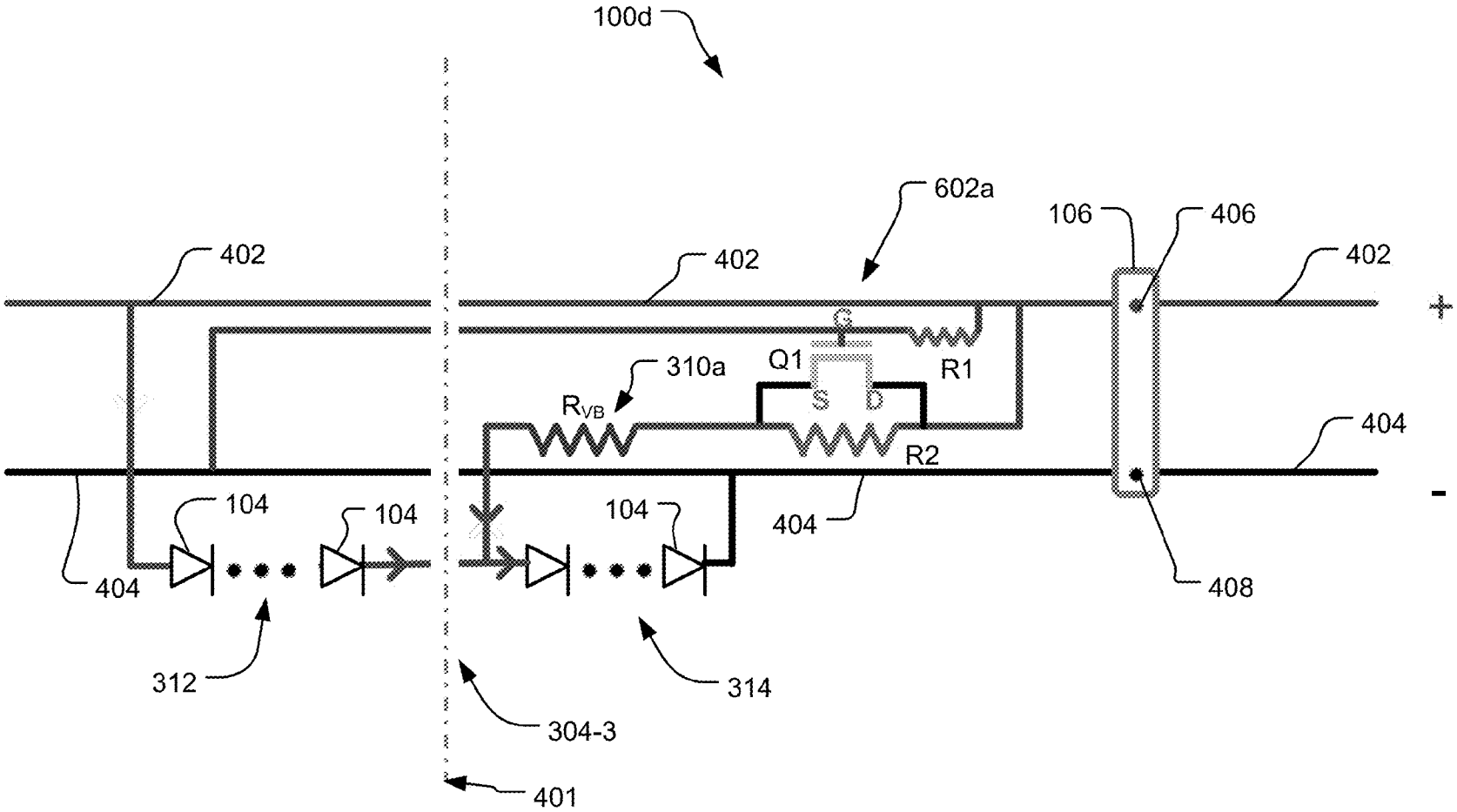
FIG. 7 diagrammatically illustrates one embodiment of the cuttable flexible light engine shown in FIG. 6 according to embodiments disclosed herein FIG. 8 diagrammatically illustrates another embodiment of the cuttable flexible light engine shown in FIG. 6 according to embodiments disclosed herein.

The switch circuit 602 may be, and in some embodiments is, provided in a variety of configurations. FIG. 7, for example, illustrates an embodiment of a flexible light engine 100*d* that is related to the flexible light engine 100*c* shown in FIG. 6. In FIG. 7, a switch circuit 602*a* includes an N-type metal-oxide field effect transistor (MOSFET) Q1, a first resistor R1, and a second resistor R2. The flexible light engine 100*d* includes a voltage balancer 310*d* configured as a voltage balance resistor $R_{VB}$. The MOSFET Q1 includes a gate G, a source S, and a drain D. The gate G of the MOSFET Q1 is coupled to the first conductive path 402 through the first resistor R1. The drain D of the MOSFET Q1 is coupled to the first conductive path 402, and the second resistor R2 is coupled in parallel with the MOSFET Q1 between the source S and the drain D of the MOSFET Q1. One end of the voltage balance resistor $R_{VB}$ is coupled to the source S of the MOSFET Q1 and the other end of the voltage balance resistor $R_{VB}$ is coupled to the remaining solid state light sources 314 adjacent the designated cut location indicated by the line 401, i.e. prior to a cut at the line 401. Prior to a cut at the designated cut location along the line 401, the gate G of the MOSFET Q1 is coupled to the second conductive path 404. When the gate G of the MOSFET Q1 is coupled to the second conductive path 404, the gate G of the MOSFET Q1 is at a low voltage and the MOSFET Q1 is in a non-conducting state. When the MOSFET Q1 is in a non-conducting state, current flow through the voltage balance resistor $R_{VB}$ is blocked and the entire string 304-3 of solid state light sources 104 is coupled in series across the first conductive path 402 and the second conductive path 404, e.g. in parallel with other strings of solid state light sources (e.g., the strings 304-1 and 304-2 shown in FIG. 3) that are not shown in FIG. 7 for ease of illustration. The second resistor R2 may be, and in some embodiments is, a relatively large resistor to block any leakage current between the drain D and source S of the MOSFET Q1 when the MOSFET Q1 is in a non-conducting state. In some embodiments, for example, the second resistor R2 has a value of 1 mega (M) ohm. Depending on the leakage current characteristics of the MOSFET Q1, however, the second resistor R2 may not be necessary.

When the flexible light engine 100*d* is cut at the designated cut location indicated by the line 401, the voltage at the gate G of the MOSFET Q1 increases to automatically place the MOSFET Q1 in a conducting state. The first resistor R1 establishes the voltage at the gate G of the MOSFET Q1 when a cut is made at the line 401. In some embodiments, for example, the first resistor R1 has a value of 100 kilo (k) ohms. When the MOSFET Q1 is in a conducting state, current flows from the first conductive path 402, through the MOSFET Q1 (around the second resistor R2), and through a series connection of the voltage balance resistor $R_{VB}$ with the remaining solid state light sources 314. As discussed above, the value of the voltage balance resistor $R_{VB}$ is selected, in some embodiments, so that the current through the series combination of the voltage balance resistor $R_{VB}$ and the remaining solid state light sources 314 after the cut is substantially the same as the current through the string 304-3 of solid state light sources 104 prior to the cut. For example, in some embodiments wherein the portion 312 of the string 304-3 that is cut out includes five solid state light sources 104 and the remaining solid state light sources 314 in the string 304-3 and the flexible light engine 100*d* includes five solid state light sources 104, the voltage balance resistor $R_{VB}$ has a value of 175 ohms.

Figure 8:
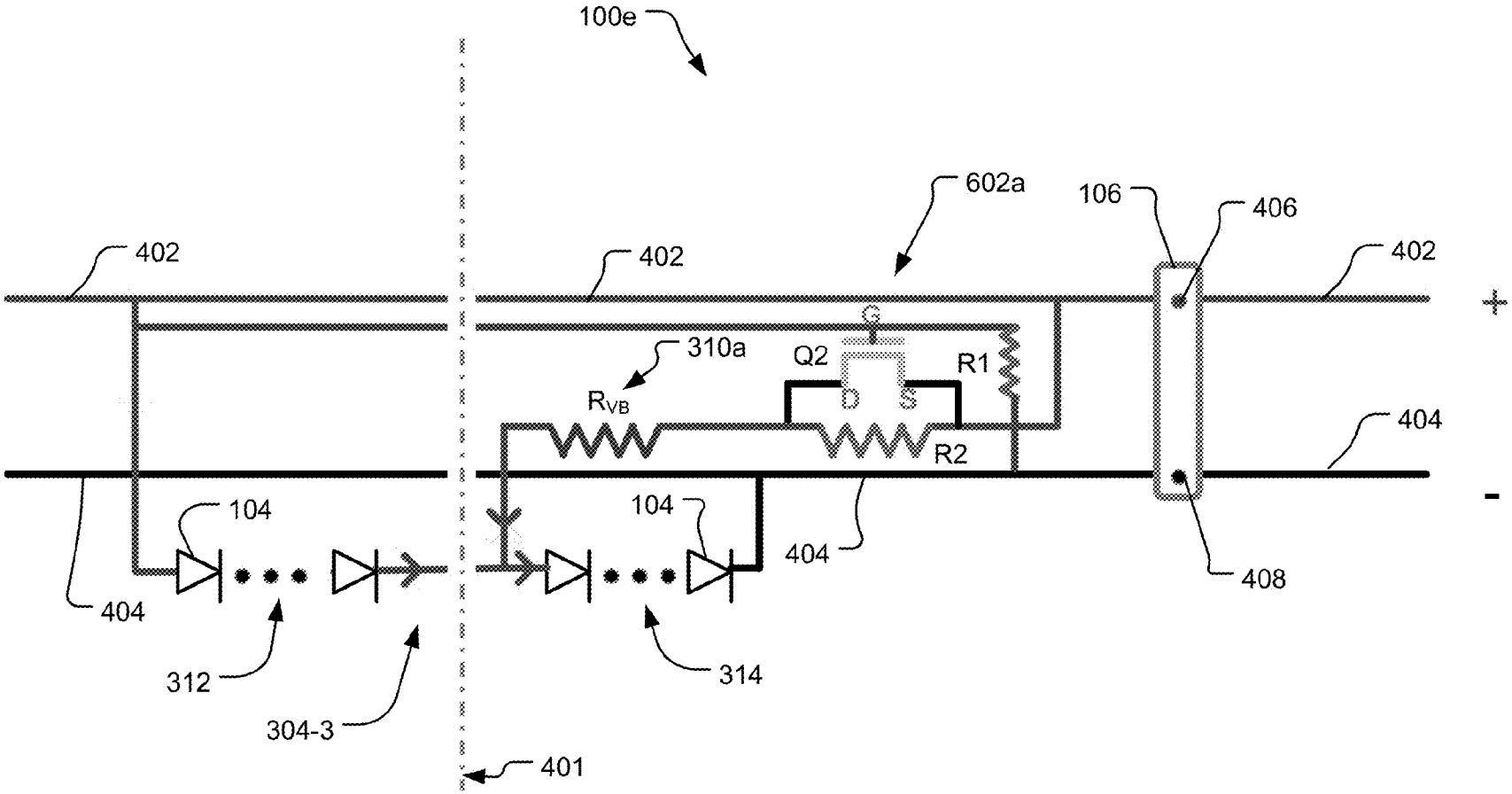

FIG. 8 illustrates an embodiment of a flexible light engine 100*e* that is related to the flexible light engine 100*c* shown in FIG. 6. In the flexible light engine 100*e* of FIG. 8, a switch circuit 602*b* includes a P-type MOSFET Q2 having a gate G, a source S, and a drain D, a first resistor R1*b*, and a second resistor R2*b*. The flexible light engine 100*e* includes a voltage balancer 310*e* configured as a voltage balance resistor $R_{VB}$. The gate G of the MOSFET Q2 is coupled to the second conductive path 404 through the first resistor R1*b*. The source S of the MOSFET Q2 is coupled to the first conductive path 402, and the second resistor R2*b* is coupled in parallel with the MOSFET Q2 between the source S and the drain D of the MOSFET Q2. One end of the voltage balance resistor $R_{VB}$ is coupled to the drain D of the MOSFET Q2 and the other end of the voltage balance resistor $R_{VB}$ is coupled to the remaining solid state light sources 314 adjacent the designated cut location indicated by the line 401, i.e. prior to a cut at the line 401. Prior to a cut at the designated cut location along the line 401, the gate G of the MOSFET Q2 is coupled to the first conductive path 402. When the gate G of the MOSFET Q2 is coupled to first conductive path 402, the gate G of the MOSFET Q2 is at a high voltage and the MOSFET Q2 is in a non-conducting state. When the MOSFET Q2 is in a non-conducting state, current flow through the voltage balance resistor $R_{VB}$ is blocked and the entire string 304-3 of solid state light sources 104 is coupled in series across the first conductive path 402 and the second conductive path 404, e.g. in parallel with other strings of solid state light sources (e.g., the strings 304-1 and 304-2 shown in FIG. 3) that are not shown in FIG. 8 for ease of illustration. The second resistor R2*b* may be, and in some embodiments is, a relatively large resistor to block any leakage current between the drain D and source S of the MOSFET Q2 when the MOSFET Q2 is in a non-conducting state. Depending on the leakage current characteristics of the MOSFET Q2, however, the second resistor R2*b* may not be necessary.

When the flexible light engine 100*e* is cut at the designated cut location indicated by the line 401, the voltage at the gate G of the MOSFET Q2 decreases to automatically place the MOSFET Q2 in a conducting state. The first resistor R1*b* establishes the voltage at the gate G of the MOSFET Q2 when a cut is made at the line 401. When the MOSFET Q2 is in a conducting state, current flows from the first conductive path 402, through the MOSFET Q2 (around the second resistor R2*b*) and through the series connection of the voltage balance resistor $R_{VB}$ with the remaining solid state light sources 314.

Figure 9:
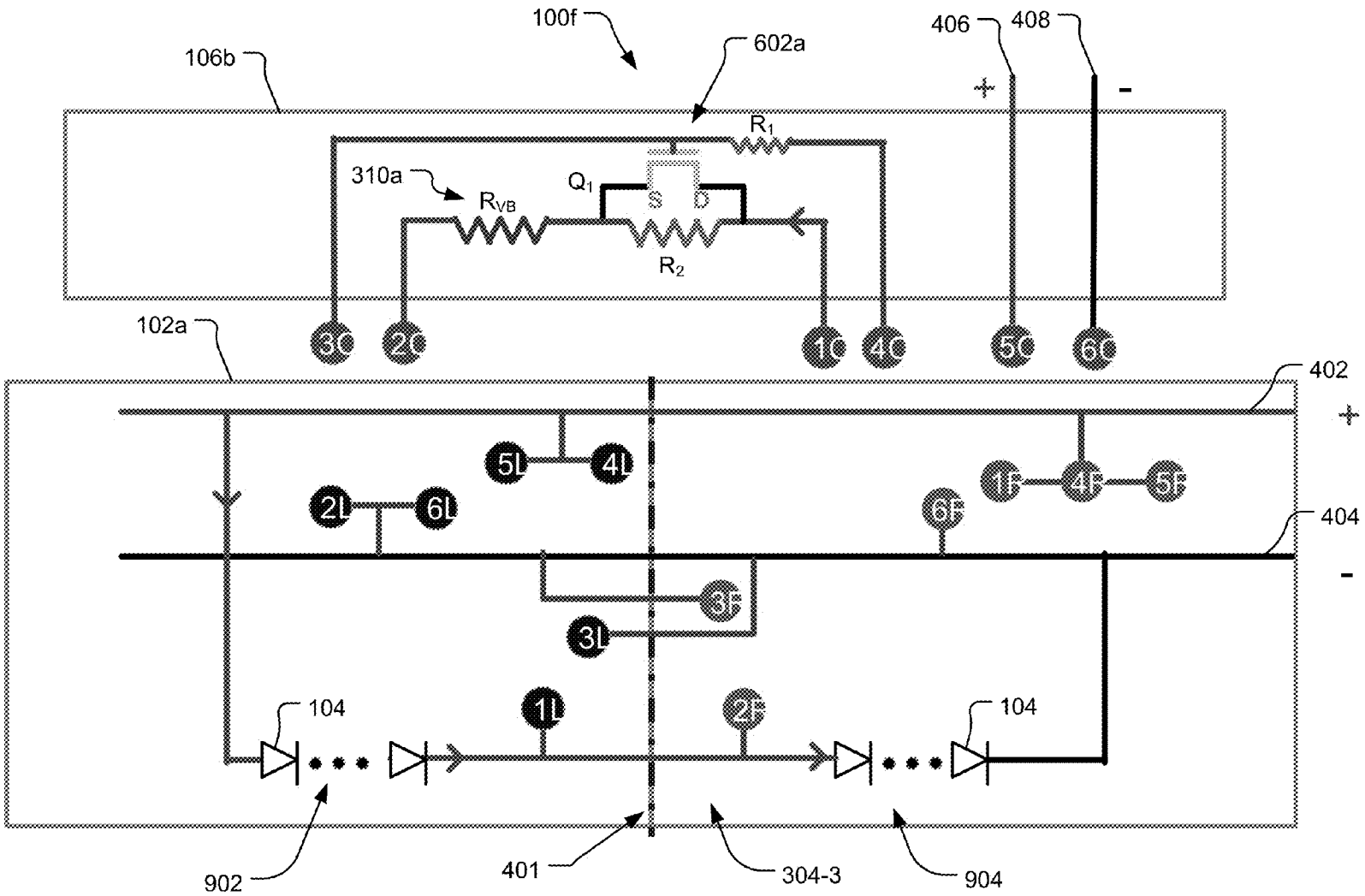
FIG. 9 diagrammatically illustrates a cuttable flexible light engine including a switch circuit according to embodiments disclosed herein.

FIG. 9 diagrammatically illustrates another embodiment of a flexible light engine 100*f* related to the flexible light engine 100*c* shown in FIG. 6. The flexible light engine 100*f* shown in FIG. 9 is similar to the flexible light engine 100*d* shown and described in connection with FIG. 7, except that in FIG. 9, a switch circuit 602*c* and a voltage balancer 310*f* are provided in a connector 106*c* of the flexible light engine 100*f* as opposed to in the flexible strip 102*a* of the flexible light engine 100*f*. The switch circuit 602*c* comprises an N-type MOSFET Q1, having a gate G, a source S, and a drain D, along with a first resistor R1 and a second resistor R2, while the voltage balancer 310*f* comprises a voltage balance resistor $R_{VB}$. The connector 106*b*, in some embodiments, is coupled to the first conductive path 402 and the second conductive path 404, so that either a left side 902 or a right side 904 of the string 304-3, as viewed in FIG. 9, may be coupled to a constant current power supply (such as but not limited to the constant current power supply 302 of FIG. 3) after a cut at a designated cut location indicated by the line 401. In particular, the connector 106*c* includes a first pin 1C coupled to the drain D of the MOSFET Q1, a second pin 2C coupled to the voltage balance resistor $R_{VB}$, a third pin 3C coupled to the gate G of the MOSFET Q1, a fourth pin 4C coupled to the first resistor R1, a fifth pin 5C coupled to the connection point 406 for connection to the first conductive path 402 and a sixth pin coupled to the connection point 408 for connection to the second conductive path 404. To connect the connector 106*b* so that the right side 904 of the string 304-3 may be coupled to the constant current power supply (not shown) after a cut at the designated location indicated by the line 401, as illustrated in FIG. 7, the first pin 1C, the second pin 2C, the third pin 3C, the fourth pin 4C, the fifth pin 5C, and the sixth pin 6C of the connector 106*c* are coupled to, respectively, a first right location 1R, a second right location 2R, a third right location 3R, a fourth right location 4R, a fifth right location 5R, and a sixth right location 6R, on the flexible strip 102*a* of the flexible light engine 100*f*. To connect the connector 106*b* so that the left side 902 of the string 304-3 may be coupled to the constant current power supply (not shown) after a cut at the designated location indicated by the line 401, the first pin 1C, the second pin 2C, the third pin 3C, the fourth pin 4C, the fifth pin 5C, and the sixth pin 6C of the connector 106*c* are coupled to a first left location 1L, a second left location 2L, a third left location 3L, a fourth left location 4L, a fifth left location 5L, and a sixth left location 6L, respectively, on the flexible strip 102*a* of the flexible light engine 100*f*.

Figure 10:
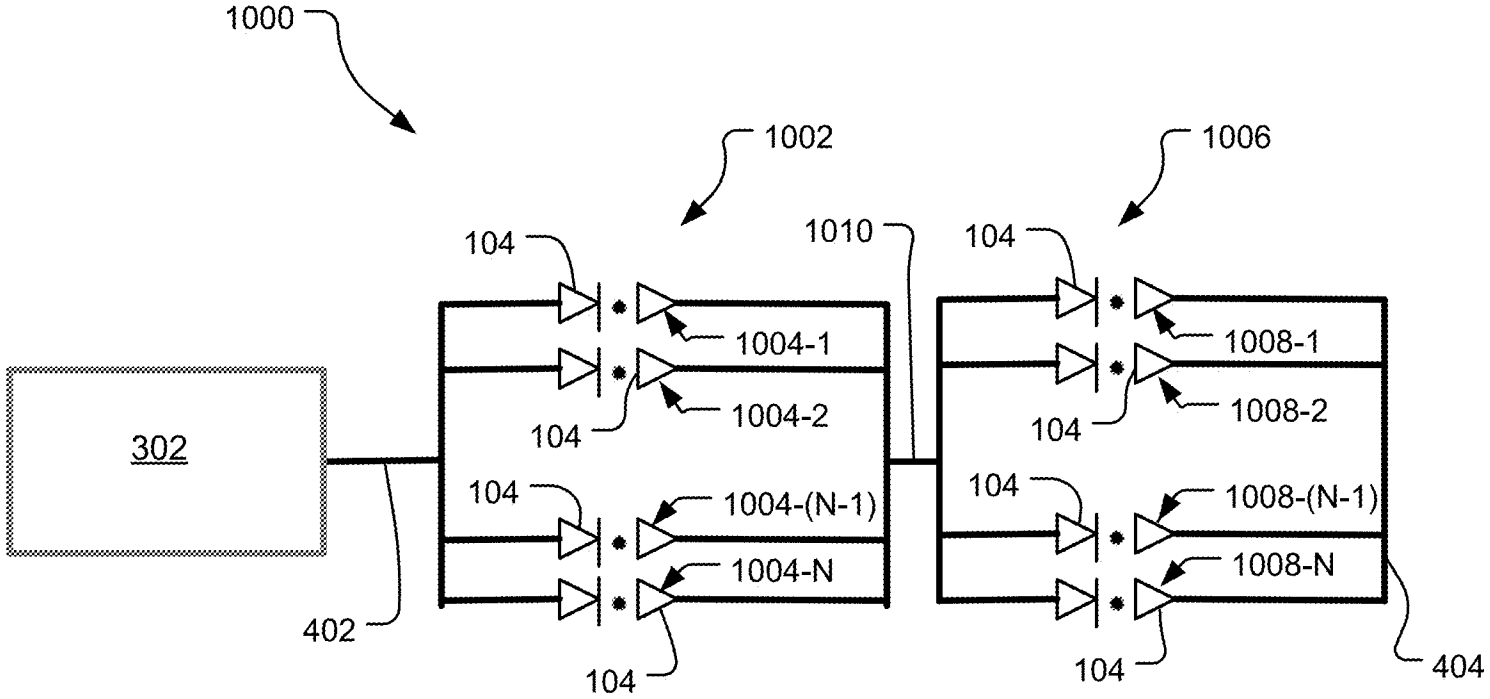
FIG. 10 is a circuit diagram illustrating a circuit formed in a cuttable flexible light engine according to embodiments disclosed herein.

FIG. 10 is a circuit diagram of an electrical circuit 1000 formed in a flexible light engine. The electrical circuit 1000 includes a constant current power supply 302 coupled to a first set 1002 of strings 1004-1, 1004-2 . . . 1004-(N−1), 1004-N of solid state light sources 104 and a second set 1006 of strings 1008-1, 1008-2 . . . 1008-(N−1), 1008-N of solid state light sources 104. The strings 1004-1, 1004-2 . . . 1004-(N−1), 1004-N of the first set 1002 are coupled in parallel between the first conductive path 402 and an intermediate conductive path 1010 and the strings 1008-1, 1008-2 . . . 1008-(N−1), 1008-N of the second set 1006 are coupled in parallel between the intermediate conductive path 1010 and the second conductive path 404.

Figure 11:
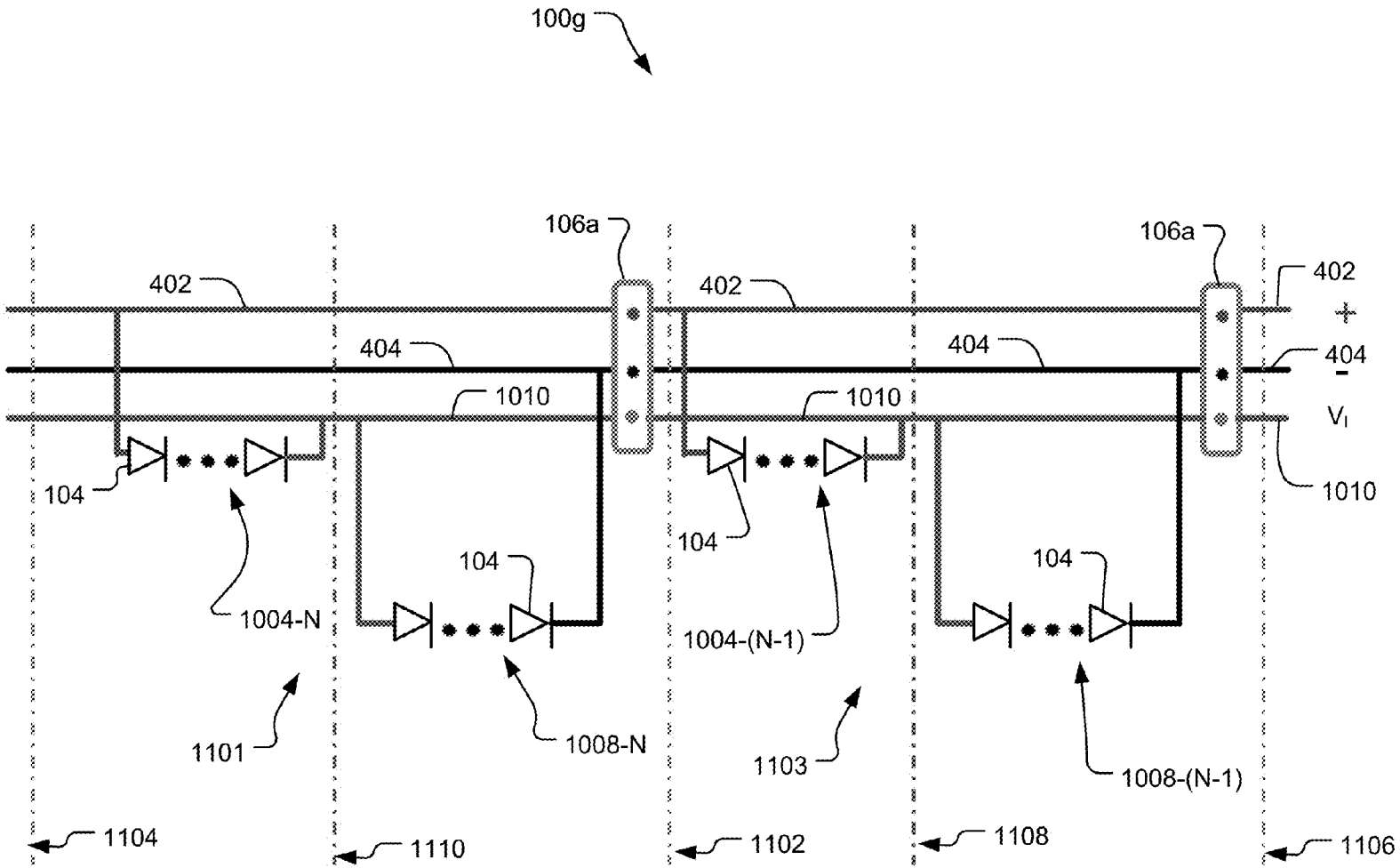
FIG. 11 diagrammatically illustrates a cuttable flexible light engine according to embodiments disclosed herein.

FIG. 11 diagrammatically illustrates a flexible light engine 100*g* configured similarly to the electrical circuit 1000 shown in FIG. 10. In FIG. 11, the strings 1004-1, 1004-2, . . . 1004-(N−1), 1004-N of solid state light sources 104 are coupled in parallel between the first conductive path 402 and an intermediate conductive path 1010, and the strings 1008-1, 1008-2, . . . 1008-(N−1), 1008-N of solid state light sources 104 are coupled in parallel between the intermediate conductive path 1010 and the second conductive path 404. The first conductive path 402 is coupled to a positive terminal (+) of a constant current power supply (not shown in FIG. 11) and the second conductive path 404 may be coupled to the negative terminal (−) of the constant current power supply. The intermediate conductive path 1010 may be, and in some embodiments is, coupled to an intermediate terminal (not shown) of the constant current power supply (not shown in FIG. 11) and may be at a voltage $V_I$ between the voltages at the first conductive path 402 and the second conductive path 404. A plurality of connectors 106*a* may be, and in some embodiments are, positioned between pairs 1101, 1103 of strings of solid state light sources 104 for providing facile electrical connection to the first conductive path 402, the second conductive path 404, and the intermediate conductive path 1010. Each pair 1101, 1103 of strings may, and in some embodiments does, include at least one string from the first set 1002 of strings 1004-1, 1004-2, . . . , 1004-(N−1), 1004-N of solid state light sources 104, such as the strings 1004-N and 1004-(N−1), coupled between the first conductive path 402 and the second conductive path 404 and at least one other string from the second set 1006 of strings 1008-1, 1008-2, . . . , 1008-(N−1), 1008-N of solid state light sources 104, such as the strings 1008-N and 1008-(N−1), coupled between the intermediate conductive path 1010 and the second conductive path 404. In FIG. 11, a cut may be made between adjacent pairs 1101, 1103 of strings, e.g. along lines 1102, 1104, or 1106, to remove one or more pairs 1101, 1103 of strings. For example, a cut may be made along the line 1102 to remove the pair of strings 1101 including the string 1004-N and the string 1008-N from the flexible light engine 100*g*. In such a configuration, the number N of strings in each of the first set of strings 1002 and the second set of strings 1006 may be selected so that the change in current through the remaining strings 1004-1, 1004-2 . . . 1004-(N−1) in the first set of strings 1002 and the remaining strings 1008-1, 1008-2 . . . 1008-(N−1) in the second set of strings 1006 resulting from removing the strings 1004-N and 1008-N is small enough to avoid damage and any readily noticeable difference in the light output of the remaining strings 1004-1, 1004-2 . . . 1004-(N−1) in the first set of strings 1002 and the remaining strings 1008-1, 1008-2 . . . 1008-(N−1) in the second set of strings 1006. Although a voltage balancer, such as but not limited to the voltage balancer 310 shown in FIG. 3, could be implemented in such a configuration, as described above, it would not be required.

For example, in an embodiment configured as shown in FIG. 10 wherein each of the sets 1002, 1006 of solid state light sources 104 includes more than five strings (i.e., N>5) of five series-connected solid state light sources 104, the change in current through the remaining strings 1004-1, 1004-2 . . . 1004-(N−1) of the first set of strings 1002 and the remaining strings 1008-1, 1008-2 . . . 1008-(N−1) of the second set of strings 1006 when one of the strings, i.e., the strings 1004-N and 1008-N, respectively, are cut from the sets 1002, 1006, respectively, compared to the prior to the cut, is less than 17%. This change may not cause damage to the solid state light sources 104 or a noticeable change in the output of the solid state light sources 104 in the remaining strings 1004-1, 1004-2 . . . 1004-(N−1) of the first set of strings 1002 or the remaining strings 1008-1, 1008-2 . . . 1008-(N−1) of the second set of strings 1006. Alternatively, and with reference again to FIG. 11, a cut may be made between a pair 1102 or 1104 of strings, e.g. along lines 1108 or 1110. For example, a cut may be made along the line 1110 to remove the last string 1004-N of solid state light sources 104 in the first set of strings 1002 from the flexible light engine 100*h*. In such a configuration, the number N of strings in each of the sets 1002, 1006 may be selected so that the change in current through the remaining strings 1004-1, 1004-2 . . . 1004-(N−1) in the first set of strings 1002 resulting from removing the string 1004-N is small enough to avoid damage and any readily noticeable difference in the light output of the remaining strings 1004-1, 1004-2 . . . 1004-(N−1) in the first set of strings 1002. Although a voltage balancer, such as but not limited to the voltage balancer 310 of FIG. 3, could be implemented in such a configuration, as described above, it would not be required.

Figure 12:
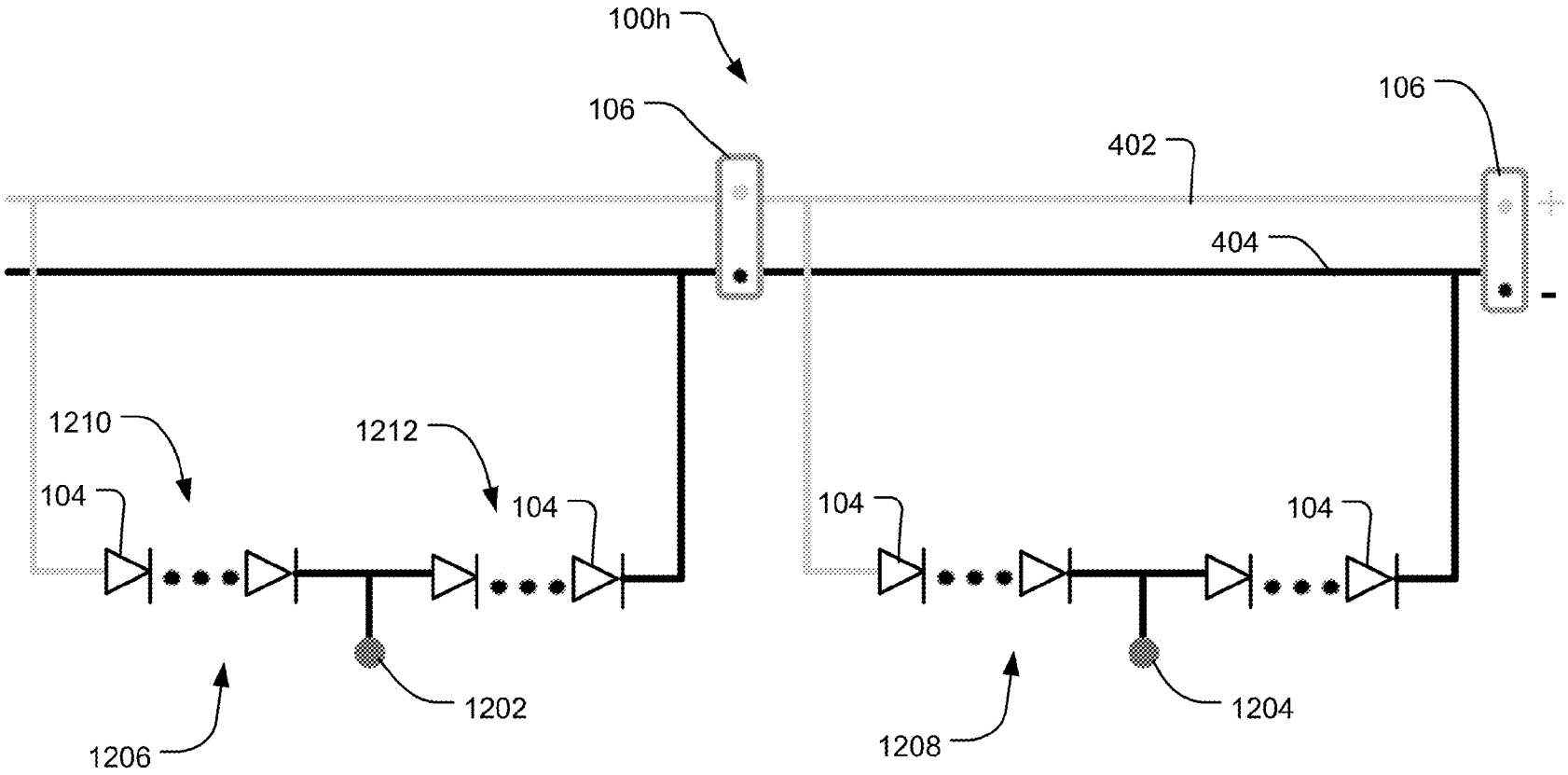
FIG. 12 diagrammatically illustrates a cuttable flexible light engine according to embodiments disclosed herein.

Any embodiment of a cuttable flexible light engine described throughout or otherwise consistent with the present disclosure, such as the cuttable flexible light engine 100 of FIG. 1, may be manufactured and stored in long lengths and cut to any desired length. In some embodiments, for example, prior to cutting a cuttable flexible light engine to a desired length, a cuttable flexible light engine consistent with the present disclosure may have an overall length of twenty meters (m) with two hundred and sixteen parallel-connected strings of solid state light sources. Powering all of the parallel-connected strings of solid state light sources to test the cuttable flexible light engine may require a current that would damage the substrate of the flexible strip. To facilitate testing of the cuttable flexible light engine, therefore, the cuttable flexible light engine may be, and in some embodiments is, provided with a test point within each of the plurality of parallel-connected strings of solid state light sources. FIG. 12 illustrates a cuttable flexible light engine 100*h* with test points 1202, 1204 within strings 1206, 1208 of solid state light sources 104 connected in parallel between a first conductive path 402 and a second conductive path 404. To test the cuttable flexible light engine 100*h*, the string 1206 is tested independently of the string 1208 by first applying a voltage between the first conductive path 402 and the test point 1202 associated with the string 1206, and then applying a voltage between that same test point 1202 and the second conductive path 404. The process is repeated with the second string 1208. As a further example in regards to the cuttable flexible light engine 100*h*, to test the string 1206 of solid state light sources 104, a voltage may be applied between the first conductive path 402 and the test point 1202 to energize a first set 1210 of the string 1206 of solid state light sources 104. If the solid state light sources 104 in the first set 1210 of the string 1206 of solid state light sources 102 emit an expected light in response to the applied voltage, then the solid state light sources 104 in the first set 1210 of the string 1206 of solid state light sources 104 may be considered operational. A voltage may then be applied between the test point 1202 and the second conductive path 404 to energize a second set 1212 of the string 1206 of solid state light sources 104. If the solid state light sources 104 in the second set 1212 of the string 1206 of solid state light sources 104 emit an expected light in response to the applied voltage, then the solid state light sources 104 in the second set 1212 of the string 1206 of solid state light sources 104 may be considered operational.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Spatially relative terms, such as "beneath," below," upper," "lower," "above", "left", "right" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as "below" or "beneath" other elements or features would then be oriented "above" the other elements or features. Thus, the exemplary term "below" may encompass both an orientation of above and below. The device may be otherwise oriented (rotated 90 degrees or at other orientations) and the spatially relative descriptors used herein interpreted accordingly.

Although the terms "first," "second," "third" etc. may be used to describe various elements, components, regions, layers and/or sections, these elements, components, regions, layers and/or sections are not to be limited by these terms as they are used only to distinguish one element, component, region, layer or section from another element, component, region, layer or section. Thus, a first element, component, region, layer or section could be termed a second element, component, region, layer or section without departing from the scope and teachings of the present invention.

As used in any embodiment herein, a "circuit" or "circuitry" may comprise, for example, singly or in any combination, hardwired circuitry, programmable circuitry, state machine circuitry, and/or firmware that stores instructions executed by programmable circuitry.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A flexible light engine comprising:

a flexible strip;

a first string of solid state light sources, comprising a first plurality of solid state light sources, and a second string of solid state light sources, comprising a second plurality of solid state light sources, coupled to the flexible strip; and a voltage balancer coupled to at least the first string of solid state light sources, wherein the voltage balancer is configured to establish a desired current flow through the first string of solid state light sources and the second string of solid state light sources, wherein the voltage balancer is coupled in series with the first string of solid state light sources between a first conductive path and a second conductive path, and the series connection between the first string of solid state light sources and the voltage balancer is coupled in parallel with the second string of solid state light sources.

2. The flexible light engine of claim 1, wherein the voltage balancer is provided in a connector coupled to the flexible strip.

3. The flexible light engine of claim 1, further comprising:

a connector having a first connection point coupled to a first conductive path and a second connection point coupled to a second conductive path, wherein the voltage balancer is coupled between an intermediate connection point of the connector and the first string of solid state light sources adjacent a designated cut location, and wherein the first string of solid state light sources and the second string of solid state light sources are coupled in parallel between the first conductive path and the second conductive path prior to a cut at the designated cut location, and wherein the voltage balancer is configured to be coupled in series with a portion of the first string of solid state light sources between the first conductive path and the second conductive path by connecting the first connection point to the additional connection point after the flexible strip is cut at the designated cut location.

4. The flexible light engine of claim 1, wherein the voltage balancer is coupled to the first string of solid state light sources adjacent a designated cut location, and wherein the flexible light engine further comprises a switch circuit coupled to the voltage balancer, the switch circuit having a first state and a second state, the first state being configured to couple the first string of solid state light sources and the second string of solid state light sources in parallel between a first conductive path and a second conductive path, the second state configured to couple the voltage balancer in series with a portion of the first string of solid state light sources between the first conductive path and the second conductive path, whereby the switch circuit is configured to automatically enter the second state when the flexible strip is cut at the designated cut location.

5. The flexible light engine of claim 4, wherein the voltage balancer and the switch circuit are provided in a connector coupled to the flexible strip.

6. The flexible light engine of claim 4, wherein the switch circuit comprises a transistor.

7. The flexible light engine of claim 1, the flexible light engine further comprising a plurality of test points along a length of the flexible strip, a first test point in the plurality of test points being positioned within the first string of solid state light sources and a second test point in the plurality of test points being positioned within the second string of solid state light sources.

8. A flexible light engine, comprising:

a flexible strip; and a plurality of strings of solid state light sources coupled to the flexible strip, a first set of strings of solid state light sources in the plurality of strings of solid state light sources being coupled in parallel between a first conductive path and an intermediate conductive path, and a second set of strings of solid state light sources in the plurality of strings of solid state light sources being coupled in parallel between the intermediate conductive path and a second conductive path; and a plurality of connectors coupled to the flexible strip, whereby pairs of strings of solid state light sources in the plurality of strings of solid state light sources are coupled to the flexible strip between associated successive ones of the plurality of connectors, each pair of strings of solid state light sources in the plurality of strings of solid state light sources comprising one of the strings of solid state light sources from the first set of strings of solid state light sources in the plurality of strings of solid state light sources and one of the strings of solid state light sources from the second set of strings of solid state light sources in the plurality of strings of solid state light sources.

9. The flexible light engine of claim 8, wherein the number of the plurality of strings of solid state light sources in each of the first set of strings of solid state light sources and the second set of strings of solid state light sources is greater than five.

10. A method of making a flexible light engine, comprising:

providing a flexible strip having a plurality solid state light sources coupled thereto, the plurality of solid state light sources being configured in strings of the solid state light sources coupled in parallel;

cutting the flexible strip to establish a length of the flexible light engine, whereby the flexible light engine comprises a portion of the flexible strip and a plurality of remaining ones of the solid state light sources coupled to the portion of the flexible strip, wherein the plurality of remaining ones of the solid state light sources comprises a portion of one of the strings of the solid state light sources; and coupling a voltage balancer to the plurality of remaining ones of the solid state light sources by coupling the voltage balancer in series with the portion of one of the strings of the solid state light sources by automatically changing the state of a switch by the cutting the flexible strip to establish the length of the flexible light engine.

11. A method of making a flexible light engine, comprising:

providing a flexible strip;

coupling a plurality of strings of solid state light sources to the flexible strip, wherein the plurality of strings of solid state light sources comprises a first set of strings and a second set of strings, wherein the first set of strings is coupled in parallel between a first conductive path and an intermediate conductive path, and wherein the second set of strings is coupled in parallel between the intermediate conductive path and a second conductive path; and coupling a plurality of connectors to the flexible strip, whereby pairs of the plurality of strings of solid state light sources are coupled to the flexible strip between associated successive ones of the connectors in the plurality of connectors, each pair of the plurality of strings of solid state light sources comprising one of the strings of solid state light sources from the first set of strings and one of the strings of solid state light sources from the second set of strings.

12. The method of claim 11, further comprising:

cutting the flexible strip to remove at least one of the strings of solid state light sources from the first set of strings and at least one of the strings of solid state light sources from the second set of strings.

13. The method of claim 11, further comprising:

cutting the flexible strip to remove at least one of the strings of solid state light sources from the first set of strings without removing any of the strings of solid state light sources from the second set of strings.

14. A method of making a flexible light engine, comprising:

providing a flexible strip;

coupling a plurality of strings of solid state light sources to the flexible strip in parallel between a first conductive path and a second conductive path; and providing a plurality of test points, each of the test points in the plurality of test points being positioned within an associated one of the strings of solid state light sources in the plurality of strings of solid state light sources.

15. The method of claim 14, further comprising:

testing each of the plurality of strings of solid state light sources by applying a voltage between the first conductive path and the test point associated with the string of solid state light sources in the plurality of strings of solid state light sources and applying a voltage between the test point associated with the string of solid state light sources in the plurality of strings of solid state light sources and the second conductive path.

16. A method of making a flexible light engine, comprising:

providing a flexible strip;

coupling a plurality of solid state light sources to the flexible strip;

cutting the flexible strip between two or more of the solid state light sources to establish a desired length of the flexible light engine;

coupling a constant current power supply to the flexible strip; and selecting each solid state light source in the plurality of solid state light sources by binning, such that each solid state light source in the plurality of solid state light sources has substantially the same forward voltage drop.

17. A method of making a flexible light engine, comprising:

providing a flexible strip;

coupling a plurality of strings of solid state light sources to the flexible strip, wherein the plurality of strings of solid state light sources comprises a first set of strings and a second set of strings, wherein the first set of strings is coupled in parallel between a first conductive path and an intermediate conductive path, and wherein the second set of strings is coupled in parallel between the intermediate conductive path and a second conductive path; and cutting the flexible strip to remove at least one of the strings of solid state light sources from the first set of strings and at least one of the strings of solid state light sources from the second set of strings.

18. The method of making a flexible light engine of claim 17, further comprising:

coupling a plurality of connectors to the flexible strip, whereby pairs of the plurality of strings of solid state light sources are coupled to the flexible strip between associated successive ones of the connectors in the plurality of connectors, each pair of the plurality of strings of solid state light sources comprising one of the strings of solid state light sources from the first set of strings and one of the strings of solid state light sources from the second set of strings.

19. A method of making a flexible light engine, comprising:

providing a flexible strip;

coupling a plurality of strings of solid state light sources to the flexible strip, wherein the plurality of strings of solid state light sources comprises a first set of strings and a second set of strings, wherein the first set of strings is coupled in parallel between a first conductive path and an intermediate conductive path, and wherein the second set of strings is coupled in parallel between the intermediate conductive path and a second conductive path; and cutting the flexible strip to remove at least one of the strings of solid state light sources from the first set of strings without removing any of the strings of solid state light sources from the second set of strings.

20. The method of making a flexible light engine of claim 19, further comprising:

coupling a plurality of connectors to the flexible strip, whereby pairs of the plurality of strings of solid state light sources are coupled to the flexible strip between associated successive ones of the connectors in the plurality of connectors, each pair of the plurality of strings of solid state light sources comprising one of the strings of solid state light sources from the first set of strings and one of the strings of solid state light sources from the second set of strings.

* * * * *